United States Patent [19]

Robins et al.

[11] Patent Number: 4,912,781

[45] Date of Patent: Apr. 3, 1990

[54] CUT RESISTANT YARN CONSTRUCTION AND BODY PROTECTIVE APPAREL

[76] Inventors: Steven D. Robins, Eden Prairie, Minn.; Robert H. Fleming, Jr., Ooltewah, Tenn.

[21] Appl. No.: 255,625

[22] Filed: Oct. 11, 1988

[51] Int. Cl.[4] ..... A41 19/00; D02G 3/36

[52] U.S. Cl. ..... 2/167; 2/161 R; 57/200; 57/210

[58] Field of Search ..... 2/2.5, 51, 161 R, 167, 2/243 A, 161 R, 167; 66/9 A; 57/200, 210, 230

[56] References Cited

U.S. PATENT DOCUMENTS

| | | | |
|---|---|---|---|
| 1,860,030 | 5/1932 | Hinchliff | 66/169 |
| 2,137,692 | 11/1938 | Linke | 66/193 |
| 3,883,898 | 5/1975 | Byrnes, Sr. | 2/167 |
| 3,953,893 | 5/1976 | Byrnes, Sr. | 2/51 |
| 4,004,295 | 1/1977 | Byrnes, Sr. | 2/161 R |
| 4,202,382 | 5/1980 | Westhead | 57/230 X |
| 4,384,449 | 5/1983 | Byrnes, Sr. et al. | 2/167 X |
| 4,470,251 | 9/1984 | Bettcher | 2/167 X |
| 4,534,262 | 8/1985 | Swenson | 57/230 X |
| 4,651,514 | 3/1987 | Collett | 2/167 X |
| 4,777,789 | 10/1988 | Kolmes et al. | 2/167 X |

*Primary Examiner*—Werner H. Schroeder
*Assistant Examiner*—Sara M. Current
*Attorney, Agent, or Firm*—W. Thad Adams, III

[57] ABSTRACT

A composite yarn construction particularly adapted for use in cut resistant body protective apparel and comprising a core yarn and an abrasion and cut resistant monofilament covering yarn knitted onto and encasing the core yarn in a series of cut resistant loops. The core yarn is preferably a multifilament synthetic yarn such as nylon, and the knitted yarn is stainless steel. The yarn is suitable for knitting cut resistant gloves, and apparel.

22 Claims, 2 Drawing Sheets

CUT RESISTANT YARN CONSTRUCTION AND BODY PROTECTIVE APPAREL

TECHNICAL FIELD AND BACKGROUND OF THE INVENTION

This invention relates to a composite yarn construction and cut resistant body protective apparel. The apparel is particularly adapted for use in, for example, gloves, aprons and arm and leg covers used by employees in meat processing or packing plants. In particular, the gloves permit plant employees to more safely and efficiently perform their meat cutting duties while avoiding injury due to accidental cuts from the very sharp knives which they use in their jobs. Protective gloves are described in several prior patents. For example, in U.S. Pat. No. 3,883,898, a protective glove constructed of aramid fiber is disclosed. U.S. Pat. No. 3,963,893 discloses a protective apron and glove constructed of Kevlar.

U.S. Pat. No. 4,004,295 discloses a protective glove which is knitted with some metal or wire yarns and some separate fiber yarns.

U.S. Pat. No. 4,384,449 discloses a protective glove formed of a yarn comprising a core of a flexible wire alongside an aramid fiber strand and wrapped in a conventional wrapping technique with aramid fiber strands. One strand is wrapped clockwise around the yarn and the other strand is wrapped in a counterclockwise direction.

Another technique involves wrapping steel wire around a core yarn or a core yarn with steel, and then wrapping a yarn using conventional wrapping techniques over the core.

Although claiming comfortable wear and flexibility, the yarn constructions described above are, in fact, quite stiff and subject to setting and metal fatigue. The yarn construction and apparel items disclosed in this application utilize a yarn construction which is unique and achieves an enhanced degree of comfort and cut resistance.

SUMMARY OF THE INVENTION

Therefore, it is an object of the invention to provide a cut resistant yarn for use in body protective garments.

It is another object of the invention to provide a body protective garment resistant to cuts.

It is another object of the invention to provide a cut resistant yarn which is particularly adapted for use in gloves worn by workers who use cutting implements such a knives in their jobs.

These and other objects of the present invention are achieved in the preferred embodiments disclosed below by providing a composite yarn construction particularly adapted for use in cut resistant body protective apparel comprising a core yarn and an abrasion and out resistant monofilament covering yarn knitted onto and encasing the core yarn in a series of cut resistant loops.

According to one preferred embodiment of the invention, a second covering yarn is applied over the knitted core yarn.

According to another preferred embodiment of the invention, the core yarn comprises a yarn selected from the group consisting of a synthetic multifilament yarn from between 30 and 3000 denier or a natural spun yarn from between 60ncc and incc (cotton count).

This is covered by knitting a cut and abrasion yarn over this yarn to form a knitted core. Then, a second covering yarn is wrapped over the knitted core yarn in either the "z" or "s" twist direction and a third covering yarn is wrapped over the second covering yarn in the other of the "z" or "s" twist direction to provide a balanced twist yarn having good flexibility and knitting characteristics.

According to yet another preferred embodiment of the invention, a second covering yarn is knitted over the knitted core yarn and a third covering yarn knitted over the second covering yarn, allowing it to have good flexibility and knitting characteristics.

Preferably, the knitted core yarn comprises high strength synthetic yarns overlaid with stainless steel.

According to another preferred embodiment of the invention, the core yarn comprises nylon.

According to yet another preferred embodiment of the invention, the core yarn comprises a stainless steel filament with an overlaid high strength synthetic multifilament yarn.

According to one preferred embodiment of the invention, the covering yarn comprises a yarn selected from the group consisting of metallic wire such as steel or bronze, or a monofilament high strength polymer material.

In the embodiment of the invention directed to a protective, cut resistant garment, the yarns from Which the garment is made comprise a multifilament core yarn and an abrasion and cut resistant monofilament covering yarn knitted onto and encasing the core yarn in a series of out resistant loops according to the characteristics set out above to form a knitted core yarn which can then be covered again to form a composite yarn, and then can be knit or woven into a protective garment.

According to one embodiment of the invention, the garment comprises a glove fabricated by knitting.

BRIEF DESCRIPTION OF THE DRAWINGS

Some of the objects of the invention have been set forth above. Other objects and advantages of the invention will appear as the description of the invention proceeds when taken in conjunction with the following drawings, in which.

DETAILED DESCRIPTION OF PREFERRED EMBODIMENT AND BEST MODE

Figure 1:
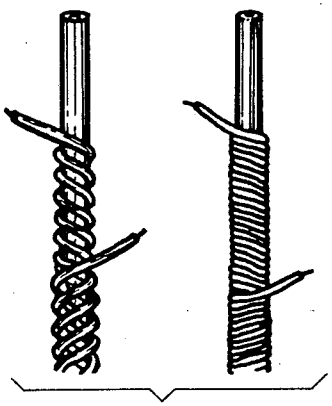
FIG. 1 PRIOR ART
FIG. 1 illustrates a prior art wrapped protective yarn, showing a core of synthetic yarn and wire run parallel, and then wrapped with clockwise and counterclockwise Kevlar or steel.

Referring now specifically to the drawings, a yarn construction according to the prior art is shown in FIG. 1. The construction shown is somewhat similar to that illustrated in U.S. Pat. No. 4,384,449 in that the yarns in each case have at least one fiber core wrapped in a conventional spiral wrapping process. In the '449 Patent, at least one of the core yarns is a flexible annealed metallic wire and the wrapper yarns are aramid fibers Another structure has a synthetic fiber core yarn wrapped with an annealed metallic wire, and then overwrapped with more synthetic multifilament material.

Figure 3:
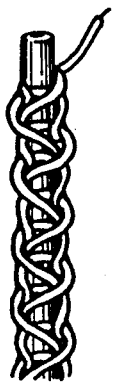
FIG. 3 more clearly illustrates the manner of knitting the covering yarn onto the core.
Figure 2:
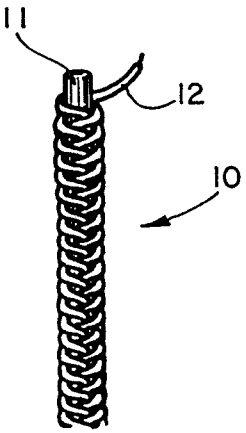
FIG. 2. illustrates a yarn construction according to the present invention.

In contrast to the structure shown in FIG. 1, the yarn 10 shown in FIG. 2 according to the present invention uses a knitting type of stitch to cover the core yarn. The knitting stitch is a type of chain stitch Which actually forms a casing around the core yarn. This is called the "guipmaille" process. The Guipmaille process has heretofore been used only to manufacture elastic yarns such as that used in undergarments and in elastic bands and ribbons. As can be seen in FIG. 2 and, particularly in FIG. 3, the process of encasing a core yarn 11 within a knitted covering 12 involves the covering yarn 12 moving in different directions about core yarn 11. This overcomes the characteristics of prior art yarns to become set in one particular position or to bend more readily in one direction than the other. The repeated change of direction which occurs in the yarn 10 shown in FIG. 2 results in a yarn which has a very high degree of flexibility. In addition, the yarn 10 can be covered with a polymer coating.

The yarn 10 comprises a non-elastic core yarn 11, preferably a high strength multifilament yarn. The covering yarn 12 comprises an abrasion and cut resistant monofilament strand such as stainless steel, or a high strength multifilament yarn. The preferable embodiment thus far developed uses a non-metallic yarn as the core yarn 11, for example, an 840 denier nylon multifilament yarn, with a .0045 inch stainless steel strand as the knitted cover yarn 12 which is applied over the core yarn 11. However, other embodiments of core yarn 11 could comprise any type of high strength synthetic fiber material.

Figure 4:
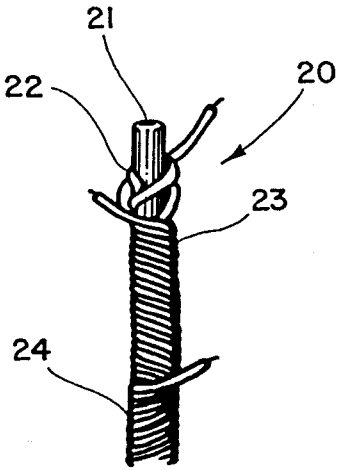
FIG. 4 is a variation on the yarn construction shown in FIGS. 2 and 8, wherein the knitted core yarn is overwrapped with two wrapper yarns, one in each of the clockwise and counterclockwise directions.

An alternate embodiment 20 shown in FIG. 4 utilizes a single multifilament core yarn 21, preferably a high strength multifilament, onto which is knitted a stainless steel covering yarn 22 such as illustrated in FIG. 2. Over the knitted covering yarn 22 is wrapped by a conventional spiral wrapping process a pair of yarns 23 and 24, such as a 650 denier nylon multifilament yarn, one in the clockwise and the other in the counterclockwise direction. These spirally wrapped yarns 23, 24 may suitably comprise a multifilament yarn having good flexibility and knitting characteristics, such as nylon or polyester.

Figure 5:
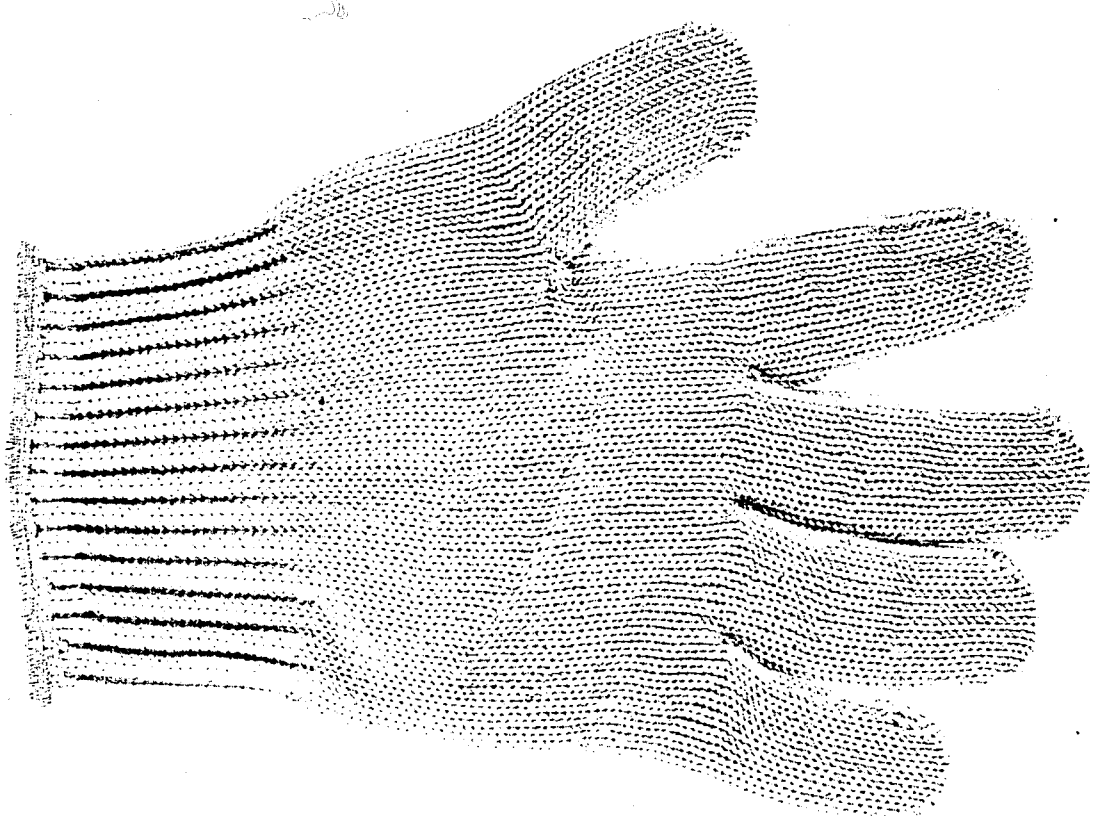
FIG. 5 illustrates a glove manufactured with the yarn construction shown in FIGS. 2 or 4.

Testing has demonstrated that a yarn 10 of the type illustrated in FIG. 2 can be manufactured on a Sodemetex MG5 or MG6 Guipmaille elastic thread covering machine. However, it is believed that other methods of knitting cover yarns over core yarns can be adapted to use with this invention, for example, Raschal or Comez Knitting. The yarns manufactured by this process can then be either woven, or knitted on, for example, a standard glove knitting machine, into a suitable protective garment, such as the glove illustrated in FIG. 5.

The structure s described above offer a number of advantages. First, there is more steel per cross section as opposed to the process in which steel is used as the core yarn or when steel is *wrapped* around core yarns. The higher percentage of steel wire per length of yarn offers greater cut resistance. The yarn pivots in any direction and offers much greater flexibility. This increases the suitability of the yarn for knitting or weaving. Garments such as gloves manufactured from this yarn offer greater comfort because of the greater flexibility of the yarn. In addition, a glove manufactured from this novel yarn conforms better to the hand. The yarn according to the embodiment shown in FIG. 2 does not have a twist direction since the wire is knitted onto the core yarn rather than wrapped. In addition, the yarn does not take a set and the possibility of metal fatigue is substantially reduced.

A composite yarn construction and cut resistant body protective garment is described above. Various details of the invention may be changed without departing from its scope. Furthermore, the foregoing description of the preferred embodiment of the invention and the best mode for practicing the invention are provided for the purpose of illustration only and not for the purpose of limitation--the invention being defined by the claims.

We claim:

1. A composite yarn construction particularly adapted for use in cut resistant body protective apparel, and comprising:

(a) a non-elastic core yarn;

(b) an abrasion and out resistant non-elastic monofilament covering yarn knitted onto and encasing the core yarn in a series of cut resistant loops.

2. A composite yarn construction according to claim 1 and including:

(c) a second covering yarn applied over the knitted covering yarn.

3. A composite yarn construction according to claim 1, wherein said core yarn comprises a yarn selected from the group consisting of:

(c) a synthetic yarn from between 30 and 3000 denier: and (d) a natural yarn from between 60ncc and incc (cotton count).

4. A composite yarn construction according to claim 1, wherein said core yarn comprises at least one yarn selected from the group consisting of:

(c) a synthetic multifilament yarn from between 3O and 3000 denier; and (d) a spun yarn from between 60ncc and incc (cotton count).

5. A composite yarn construction according to claim 1, and including:

(c) a second covering yarn wrapped over the knitted covering yarn in either the "z" or "s" twist direction; and (d) a third covering yarn wrapped over the second covering yarn in the "z" or "s" twist direction not utilized in (c), to provide a balanced twist yarn having good flexibility and knitting characteristics.

6. A composite yarn construction according to claim 1, and including:

(c) a second covering yarn knitted over the knitted covering yarn; and (d) a third covering yarn knitted over the second covering yarn.

7. A composite yarn construction according to claim 1, wherein said core yarn comprises nylon and a stainless steel knitted covering.

8. A composite yarn construction according to claim 1, wherein said core yarn comprises a multifilament yarn selected from the group consisting of SPECTRA polyethylene, VECTRAN liquid crystal polymer, KEVLAR aramid fiber, olefin, nylon or polyester.

9. A composite yarn construction according to claim 1, wherein said core yarn comprises synthetic or natural yarn and stainless steel knitted covering.

10. A composite yarn construction according to claim 1, wherein said knit covering yarn comprises a yarn selected from the group consisting of steel metallic such as bronze or any of the high strength materials like fiberglass, VECTRA, KEVLAR or SPECTRA ranging from .001 to .010 of an inch in diameter

11. A body protective, cut resistant garment fabricated from a fabric made from yarns, said yarns comprising:

(a) a non-elastic core yarn;

(b) an abrasion and cut resistant monofilament covering yarn knitted onto and encasing the core yarn in a series of cut resistant loops.

12. A body protective, cut resistant garment according to claim 11, and including:

(c) a second covering yarn applied over the knitted core yarn.

13. A body protective, cut resistant garment according to claim 11, wherein said core yarn comprises a yarn selected from the group consisting of:

(c) a synthetic yarn from between 30 and 3000 denier; and (d) a yarn from between 60ncc and incc (cotton count).

14. A body protective, cut resistant garment according to claim 11, wherein said core yarn comprises at least one yarn selected from the group consisting of:

(c) a synthetic multifilament yarn from between 30 and 3000 denier; and (d) a spun yarn from between 60ncc and incc (cotton count).

15. A body protective, cut resistant garment according to claim 11, and including:

(c) a second covering yarn wrapped over the knitted covering yarn in either the "z" or "s" twist direction; and (d) a third covering yarn wrapped over the second covering yarn in the "z" or "s" twist direction not utilized in (c), to provide a balanced twist yarn having good flexibility and knitting characteristics.

16. A body protective, cut resistant garment according to claim 11, and including:

(c) a second covering yarn knitted over the knitted covering yarn; and (d) a third covering yarn knitted over the second covering yarn.

17. A body protective, cut resistant garment according to claim 11, wherein said core yarn comprises nylon and a stainless steel knitted covering.

18. A body protective, cut resistant garment according to claim 11, wherein said core yarn comprises a yarn SPECTRA polyethylene, VECTRAN liquid crystal polymer, KEVLAR aramid fiber, olefin, nylon or polyester.

19. A body protective, cut resistant garment according to claim 11, wherein said core yarn comprises synthetic or natural yarn and stainless steel knitted covering.

20. A body protective, cut resistant garment according to claim 11, wherein said knit covering yarn comprises a yarn selected from the group consisting of steel metallic such as bronze or any of the high strength monofilament materials like Fiberglass, VECTRA or SPECTRA ranging from .001 to .010 of an inch in diameter.

21. A body protective, cut resistant garment according to claim 11, wherein said garment comprises a glove for the hand.

22. A body protective, cut resistant garment according to claim 11, wherein said garment is knitted.

* * * * *